US005268544A

United States Patent [19]

Guenther et al.

[11] Patent Number: 5,268,544

[45] Date of Patent: Dec. 7, 1993

[54] VACUUM RELAY WITH A CONTACT UNIT LOCATED IN A VACUUM

[75] Inventors: Wolfgang Guenther, Munich; Uwe Jahnke; Ralf-Reiner Volkmar, both of Berlin, all of Fed. Rep. of Germany

[73] Assignee: Siemens Aktiengesellschaft, Munich, Fed. Rep. of Germany

[21] Appl. No.: 971,692

[22] Filed: Oct. 29, 1992

Related U.S. Application Data

[63] Continuation of Ser. No. 557,552, Jul. 24, 1990, abandoned.

[30] Foreign Application Priority Data

Aug. 3, 1989 [EP] European Pat. Off. ..... 89250011.7

[51] Int. Cl.[5] ..... H01H 33/00

[52] U.S. Cl. ..... 200/144 B; 200/144 R

[58] Field of Search ..... 200/144 B; 335/151, 335/154

[56] References Cited

U.S. PATENT DOCUMENTS 3,001,046 9/1961 Racz et al. ..... 335/121

3,257,524 6/1966 Eggers et al. ..... 335/154

FOREIGN PATENT DOCUMENTS 1121497 7/1968 United Kingdom .

OTHER PUBLICATIONS

DE-Z "Siemens Components", 1986, pp. 143-147.

*Primary Examiner*—A. D. Pellinen

*Assistant Examiner*—Michael A. Friedhofer

*Attorney, Agent, or Firm*—Kenyon & Kenyon

[57] ABSTRACT

To improve the mechanical properties of a contact unit of a vacuum relay, a spring element is integrated into the contact unit. The contact unit comprises an armature, a mounting support for an insulating carrier, the insulating carrier and a switching contact. The mounting support comprises a flat bar spring such that the contact unit has an integrated spring element.

1 Claim, 2 Drawing Sheets

VACUUM RELAY WITH A CONTACT UNIT LOCATED IN A VACUUM

This application is a continuation, of application Ser. No. 07,557,552, filed Jul. 24, 1990, now abandoned.

BACKGROUND OF THE INVENTION

The present invention relates to electrical switches and is to be used in the structural design of a vacuum relay, whereby a switching contact is connected in an insulated manner to an armature of a driver system within a vacuum.

Vacuum relays can be equipped with varying types of driver systems. Usually, an electromagnet, having a clapper-type armature is used for this purpose. However, a magnetostrictive or piezoceramic driver system can also be used which has a clapper-type armature.

In a known vacuum relay of this type which has an electromagnet as the driver system, the actual contact unit of the relay consists of four parts: namely, the clapper-type armature of the electromagnet, a mounting support in the shape of a pin which is secured to the clapper-type armature, an insulating bar consisting of a ceramic material (sapphire) which is locked in position on the mounting support, and a switching contact in the form of a switching laminate which is mounted on the upper end of the insulating bar (GB-PS 1 121 497, DE-Z "Siemens Components", 1986, pp 143 to 147). The area of application of this type of a vacuum relay depends among other things on the mechanical properties of the contact unit such as mechanical stressability, switching endurance, chatter time, and contact pressure.

SUMMARY OF THE INVENTION

It is an object of the invention to improve the mechanical properties of the contact unit by means of a structural intervention in the connection between the transmission resistor element and the switching contact.

The above and other objects of the invention are achieved by a vacuum relay having a switching chamber and a driver, the switching chamber being separated in a vacuum-tight manner from the driver, at least two contact pieces and one contact unit being disposed in the switching chamber, the contact unit comprising an armature supported on one side, a switching contact, an insulating rod for carrying the switching contact, and a mounting support for the insulating rod fastened to the armature, the mounting support comprising a flat bar spring element.

This spring element should be a flat bar spring which is integrated into the mounting support for the bar-type carrier of the switching contact. This can be designed such that the mounting support comprises a U-shaped metal part having two flaps extending from the base. Of these two flaps, one flap is mounted between both arms and the other flap is directed opposite the arms, whereby both flaps are bent at 90° angles and a form a retainer for the insulating rod. The arms of the U-shaped metal part are also bent in their middle at 90° angles and are locked in position with the bent down part on the anchor of the electromagnet. In this case, the free-standing parts of the arms of the U-shaped metal part form two parallel bar springs.

In the contact unit of the invention, the presently typical stationary fastening of the switching contact to the armature has been abandoned. By integrating a spring element into the contact unit, a flexible abutment of the switching contact at the respective contact pieces is provided. For example, in a magnetic driver system, this can cause the armature of the electromagnet to rest on the pole surface during the attracted state, whereby equal contact forces are generated each time independent of an oscillating coil voltage. The bar springs which are integrated into the contact unit can be dimensioned such that, while interacting with the return spring of the armature, they provide a specific contact force. In the case of a fully attracted armature, therefore, a specific path or dwell pressure is able to be set. The adjustable, elastic path of the contact unit causes a greater damping of the mechanical switching impulse forces which are exerted on the switch laminate and the bar-type connecting element; furthermore, it causes an increase of the mechanical endurance of the vacuum relay and reduces the chatter times of the switching contact. Moreover, the wear and tear on the contacts can be offset by means of a predeterminable path or resilience of the contact spring. Finally, while assembling the driving member and the contact, the contact pressure to be set can be reliably adjusted and measured by way of the external contact passages in the case of a fully operating transmission resistor element.

BRIEF DESCRIPTION OF THE DRAWINGS

The invention will be described in greater detail in the following detailed description with reference to the drawings, in which.

DETAILED DESCRIPTION

Figure 1:
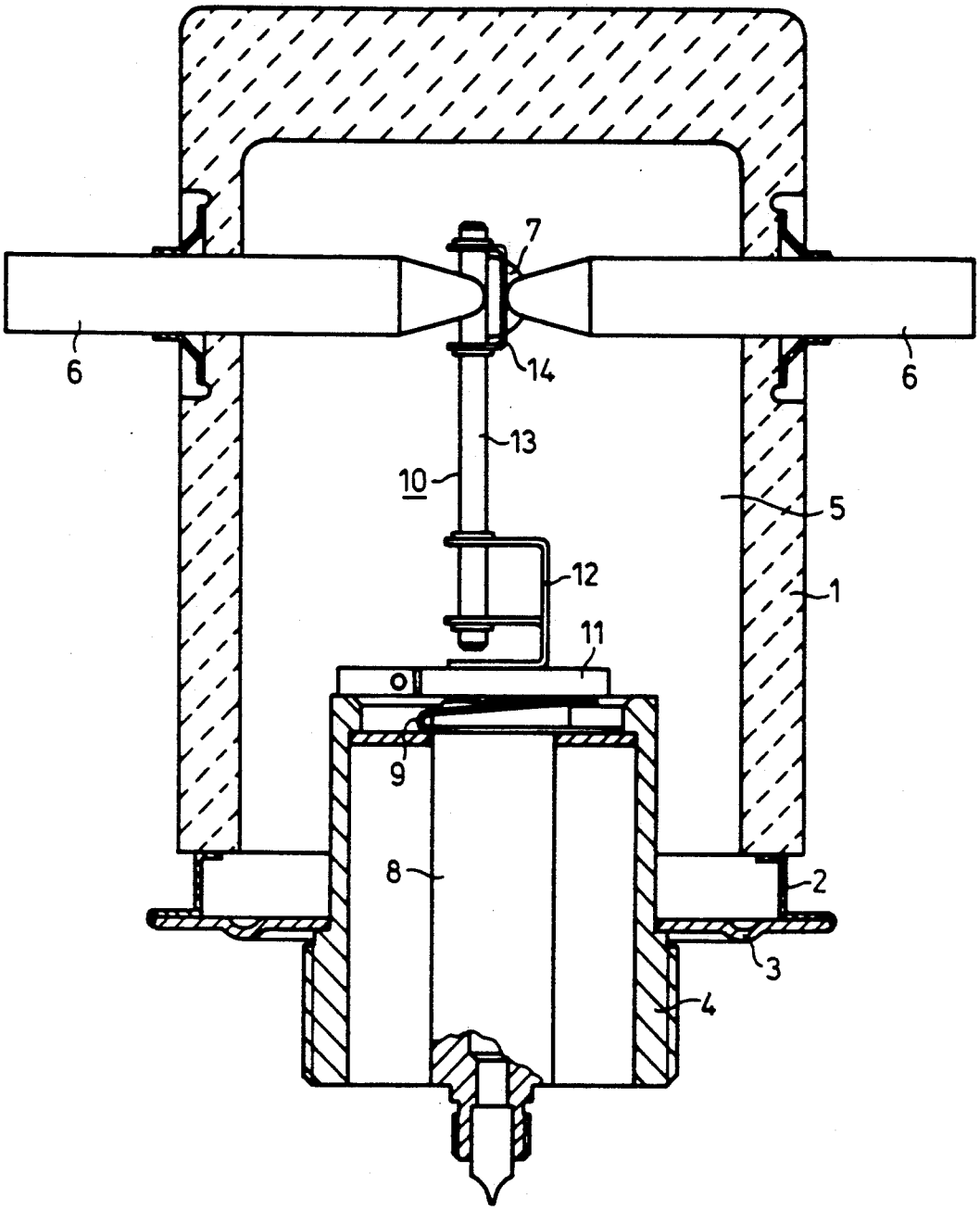
FIG. 1 shows a vacuum relay in cross section with a flexible mounting support.

With reference now to the drawings, FIG. 1 shows the casing 1 of a vacuum relay whose vacuum chamber is formed by a ceramic cup 1, an annular metal part 2, a discoid metal part 3 and a housing 4 for an electromagnet. Two opposing contacts 6 and a contact 7 which is mounted perpendicular to these contacts 6, extend into the vacuum chamber 5 thus formed.

The contact unit 10 of the vacuum relay comprises a clapper-type armature 11, which is supported by a spring 9 on a coil core 8 of the electromagnet. It further comprises a metallic mounting support 12 which is welded onto the clapper-type armature, an insulating rod 13 which is locked into position in the mounting support 12 and a switching contact 14 which is mounted on the upper end of the insulating rod.

Figure 2:
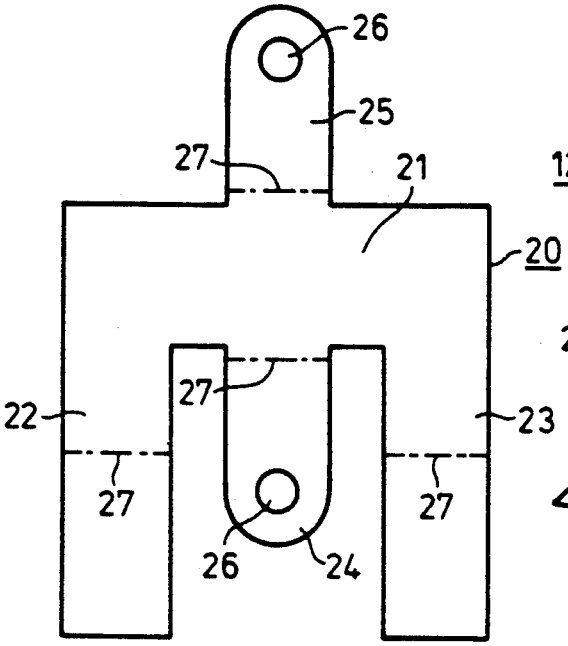
FIG. 2 shows the flexible mounting support as a flat metal piece.

According to FIG. 2, the metallic mounting support 12 is formed from a U-shaped metal part 20 which, in the unformed state, consists of the base 21, two arms 22 and 23, a flap 24 disposed between the arms and a flap 25 extending from the base which is disposed opposite the arms 22 and 23. Bore holes 26 for receiving the insulating rod 13 are provided in both flaps; furthermore, bending edges 27 are represented by a dash-dotted line.

Figure 3:
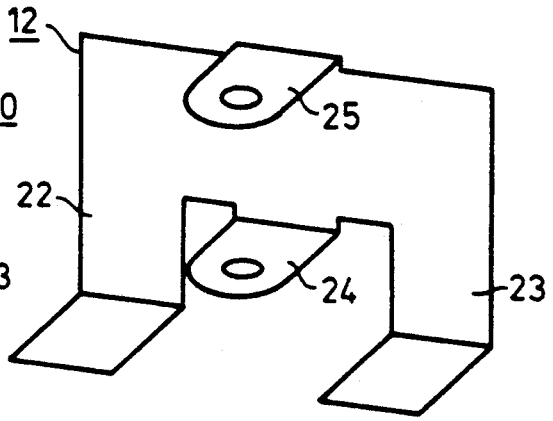
FIG. 3 shows the flexible mounting support in the assembled state.

FIG. 3 shows the U-shaped metal piece according to FIG. 2 with arms and flaps bent at an angle. The flaps 24 and 25 and the bent parts of the arms 22 and 23 are respectively bent at 90° angles and run parallel to each other. The parts of the arms 22 and 23, which are not bent at an angle and which directly adjoin the base 21, form two parallel connected bar springs.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A vacuum relay having a switching chamber and a driver, the switching chamber being separated vacuum-tight from the driver, at least two contact pieces and one contact unit being disposed in the switching chamber, the contact unit comprising an armature supported on one side, a switching contact, an insulating rod for carrying the switching contact, and a mounting support for resiliently coupling the insulating rod to the armature, the mounting support comprising a flat bar spring element, said flat bar spring element comprising a U-shaped metal part having two flaps extending from a base thereof, one flap being mounted between two arms of the U-shaped part and the other flap being disposed opposite the arms, both flaps being bent at 90° angles and forming a retainer for the insulating rod, the arms being bent approximately at the center line thereof transverse to a longitudinal extent of the arms approximately 90° angles to form respective bent parts, and the bent parts being secured to the armature.

* * * * *